US008198212B2

(12) United States Patent
Stork et al.

(10) Patent No.: US 8,198,212 B2
(45) Date of Patent: Jun. 12, 2012

(54) HEAT-SENSITIVE RECORDING MATERIAL

(75) Inventors: Gerhard Stork, Flensburg (DE); Annette Schreiber, Kosel (DE)

(73) Assignee: Mitsubishi HiTec Paper Flensburg GmbH, Flensburg (DE)

( * ) Notice: Subject to any disclaimer, the term of this patent is extended or adjusted under 35 U.S.C. 154(b) by 925 days.

(21) Appl. No.: 12/231,653

(22) Filed: Sep. 4, 2008

(65) Prior Publication Data

US 2009/0088321 A1 Apr. 2, 2009

(30) Foreign Application Priority Data

Sep. 4, 2007 (EP) ..... 07017264

(51) Int. Cl.
*B41M 5/327* (2006.01)
*B41M 5/333* (2006.01)

(52) U.S. Cl. ..... 503/217; 503/216; 503/221

(58) Field of Classification Search ..... None
See application file for complete search history.

(56) References Cited

U.S. PATENT DOCUMENTS

2005/0148467 A1 7/2005 Makitalo et al.

FOREIGN PATENT DOCUMENTS

| | | |
|---|---|---|
| DE | 10 2004 004 204 | 8/2005 |
| EP | 0526072 | 2/1993 |
| EP | 1116713 | 7/2001 |
| EP | 1243437 | 9/2002 |

*Primary Examiner* — Bruce H Hess
(74) *Attorney, Agent, or Firm* — Cozen O'Connor

(57) ABSTRACT

A heat-sensitive recording material is proposed, which comprises a substrate and a heat-sensitive recording layer that contains color formers and color acceptors, where the color formers are selected from the list comprising: 3-diethylamino-6-methyl-7-anilinofluoran, 3-dibutylamino-6-methyl-7-anilinofluoran, 3-(N-methyl-N-propyl)amino-6-methyl-7-anilinofluoran, 3-(N-ethyl-N-isoamyl)amino-6-methyl-7-anilinofluoran, 3-(N-methyl-N-cyclohexyl)amino-6-methyl-7-anilinofluoran, 3-(N-ethyl-N-tolyl)amino-6-methyl-7-anilinofluoran, and 3-(N-ethyl-N-tetrahydrofuryl) amino-6-methyl-7-anilinofluoran, the heat-sensitive recording layer contains two color acceptors, which are: N-(p-toluenesulfonyl)-N'-3-(p-toluenesulfonyloxyphenyl)urea with the following formula (1):

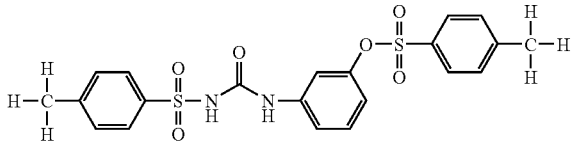

and a urea-urethane compound with the following formula (2):

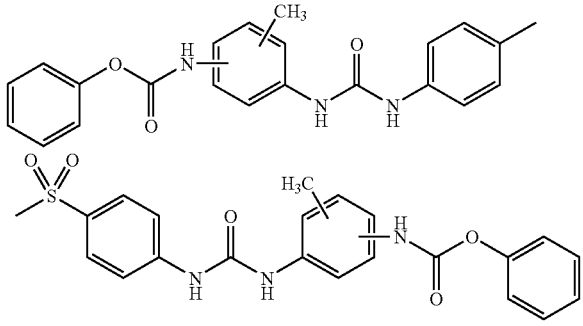

where the ratio of the two color acceptors, i.e., the ratio of N-(p-toluenesulfonyl)-N'-3-(p-toluenesulfonyloxyphenyl)urea according to formula (1) to the urea-urethane compound according to formula (2), is in the range of 10:1 to 1:1, based on wt. % in the heat-sensitive recording layer.

9 Claims, No Drawings

HEAT-SENSITIVE RECORDING MATERIAL

This application claims priority of European Application No. EP 07 017 264, filed Sep. 4, 2007, the contents of which are incorporated herein by reference.

BACKGROUND OF THE INVENTION

The present invention concerns a heat-sensitive recording material with a substrate, optionally a pigmented intermediate layer applied on the substrate, and a heat-sensitive recording layer that contains color formers and color acceptors. The present invention also concerns the use of the heat-sensitive recording material proposed here as a ticket and/or passenger ticket.

Heat-sensitive recording materials of the type described above with, for example, a sheet of paper, a sheet of synthetic paper, or a plastic film as the substrate have been well known since the early years of chemically reacting recording materials and have enjoyed steadily increasing popularity due, among other things, to the fact that their use, especially as tickets, is associated with great advantages for the issuer of the tickets. Because the color-forming components in the heat-sensitive recording process are fixed in the recording material itself, the toner-free and ink cartridge-free printers, whose operation no longer needs to be monitored by anyone, can be set up in large numbers. Accordingly, this innovative technology has been successfully implemented especially in public transportation, in buses and trains, as well as in air travel, at stadium and museum ticket counters, and in automatic parking ticket dispensers.

With the goal of improving heat-sensitive materials, especially for their use as tickets, with respect to their resistance to environmental effects, such as heat and humidity, a great many innovations have been introduced in the underlying chemistry and the manufacturing technology for producing these recording materials.

To enhance the resistance of developed thermal copies to water, aqueous alcohol solutions, and plasticizers, DE 10 2004 004 204 A1 proposes a heat-sensitive recording material whose heat-sensitive recording layer contains standard dye precursors and the combination of a phenolic color developer and a color developer based on urea-urethane.

Urea-urethane compounds are well known from EP 1 116 713 A1 and DE 692 04 777 T2 as developers, which can be used to increase the print density of developed thermal copies, including in combination with sulfonylurea, although these documents provide no indication of the outstanding effect of N-(p-toluenesulfonyl)-N'-3-(p-toluenesulfonyloxy-phenyl) urea.

The object of US 2005/0148467 A1 is a heat-sensitive recording material, which, in order to develop an irreversible print image, contains the components of at least two color forming systems, such that one of the color forming systems that is used is a chelate-type color forming system, while the other is a conventional leuco dye system. A large number of sulfonylurea compounds, including N-(p-toluenesulfonyl)-N'-3-(p-toluenesulfonyloxy-phenyl)urea, are named as a first developer, and in one embodiment, these compounds can be used in combination with urea-urethane compounds as a second developer.

SUMMARY OF THE INVENTION

A disadvantage of the recording materials according to the documents cited above is, especially in the first case, an inadequate resistance to plasticizers, combined with very poor whiteness of the recording material. Another disadvantage is the overly complicated manufacturing process, which often prevents practical use of the proposals.

Therefore, the objective of the present invention is to make available a heat-sensitive recording material, which is suitable especially for use as a ticket or passenger ticket and which, due to high sales numbers in a highly competitive market, can be produced at low production costs and therefore has a simple design. In particular, the new recording material must not need an additional protective layer to cover the heat-sensitive recording layer, because a protective layer of this type is too expensive both with respect to the raw materials that are needed for it and with respect to the machines and process energy that are needed to produce it. At the same time, however, the new recording material must exhibit excellent resistance to ethanol solutions, water, and plasticizers. In addition, the new recording material must satisfy requirements with respect to its ability to be stamped and cancelled. In accordance with the objective of the present invention, this means that stamped cancellation marks cannot be completely wiped off in either a dry or moistened state after about 10 seconds.

The objective stated above is achieved with a heat-sensitive recording material, which comprises a substrate and a heat-sensitive recording layer that contains color formers and color acceptors, where

- the color formers are selected from the list comprising: 3-diethylamino-6-methyl-7-anilinofluoran, 3-dibutylamino-6-methyl-7-anilinofluoran, 3-(N-methyl-N-propyl)amino-6-methyl-7-anilinofluoran, 3-(N-ethyl-N-isoamyl)amino-6-methyl-7-anilinofluoran, 3-(N-methyl-N-cyclohexyl)amino-6-methyl-7-anilinofluoran, 3-(N-ethyl-N-tolyl)amino-6-methyl-7-anilinofluoran, and 3-(N-ethyl-N-tetrahydrofuryl) amino-6-methyl-7-anilinofluoran,
- the heat-sensitive recording layer contains two color acceptors, which are: N-(p-toluenesulfonyl)-N'-3-(p-toluenesulfonyloxyphenyl)urea with the following formula (1):

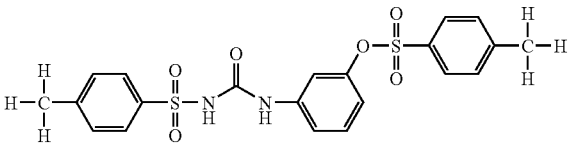

and a urea-urethane compound with the following formula (2):

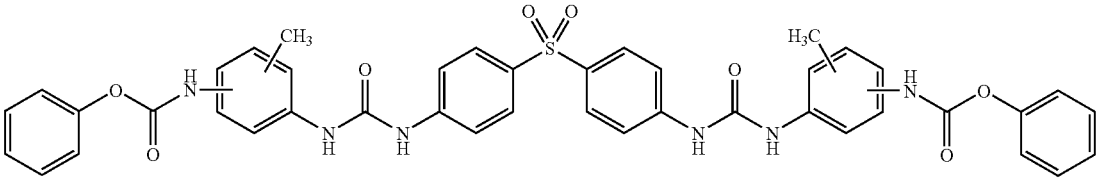

where the ratio of the two color acceptors, i.e., the ratio of N-(p-toluenesulfonyl)-N'-3-(p-toluenesulfonyloxyphenyl)urea according to formula (1) to the urea-urethane compound according to formula (2), is in the range of 10:1 to 1:1, based on wt. % in the heat-sensitive recording layer.

The present invention extends in the same way to the use of a heat-sensitive recording material of this description as a ticket or passenger ticket.

DETAILED DESCRIPTION OF THE INVENTION

To characterize its sensitivity to thermal energy supplied by a thermal printing head, the heat-sensitive recording material according to the present invention has a print density, which, carried out with a thermal printing head at a resolution of 300 dpi and an energy per unit surface area of 9 mJ/mm$^2$, is preferably in the range of 0.87 to 1.07 ODU (Optical Density Units, according to DIN 16536-1, May 1997 version) and most preferably in the range of 0.91 to 1.03 ODU.

To measure the print density, a black/white checkered thermal test copy is prepared with a device of the type Atlantek 400 manufactured by the company Printrex (USA), in which a thermal head with a resolution of 300 dpi and an energy per unit surface area of 9 mJ/mm$^2$ is used. The print density of the black-colored surfaces themselves is measured with a Gretag MacBeth type D19C NB/U densitometer (Gretag MacBeth, 8105 Regensdorf, Switzerland), in which each measured value is obtained by measuring the dynamic print densities in three places and taking the arithmetic mean of the three individual values.

The heat-sensitive recording material of the invention has preferred values for the percent resistance of a thermal test copy

- in the range of 91.5% to 96.5% and especially in the range of 92.5% to 95.5% with respect to a 25% ethanol solution,
- in the range of 95.5% to 99.5% and especially in the range of 96.5% to 99.0% with respect to water,
- in the range of 90.5% to 95.5% and especially in the range of 91.5% to 94.5% with respect to plasticizers (TESA®-Grafik-Film 57331).

Also to measure the percent resistance of a thermal test copy, a black/white checkered thermal test copy is prepared for each resistance test with a device of the type Atlantek 400 manufactured by the company Printrex (USA), in which a thermal head with a resolution of 300 dpi and an energy per unit surface area of 16 mJ/mm$^2$ is used. For each individual determination of the percent resistance of a thermal test copy to ethanol or water, first, the dynamic print density of the black-colored surfaces is measured in three places on a thermal test copy with a Gretag MacBeth type D19C NB/U densitometer (Gretag MacBeth, 8105 Regensdorf, Switzerland), and then the actual treatment of the thermal test copy is performed.

In the case of the percent resistance to a 25% ethanol solution, this treatment involves the immersion of the thermal test copy in an ethanol bath (25 vol. % solution, 23° C.) for 20 minutes. The copy is then carefully blotted with blotting paper and then allowed to stand for 24 hours at 23° C. and 50% relative humidity.

In the case of the percent resistance to water, the thermal test copy is placed in a water bath for 20 minutes (deionized water, 23° C.). It is then blotted and allowed to stand as in the ethanol treatment.

After being allowed to stand, the dynamic print density is determined again in three places on the black-colored surfaces with the Gretag MacBeth type D19C NB/U densitometer. The respective mean values of the measurements before and after the bath in the ethanol solution or water were calculated, and the mean value after the bath was compared with the mean value before the bath in the form of a percentage.

For each individual determination of the percent resistance of a thermal test copy to a plasticizer, first, a piece of TESA®-Grafik-Film 57331 about 10 cm long was pasted onto a thermal test copy prepared with a device of the type Atlantek 400 manufactured by the company Printrex (USA). The dynamic print density of the black-colored surfaces is then immediately measured in three places with the Gretag MacBeth type D19C NB/U densitometer. The copy is then allowed to stand for 24 hours at 23° C. and 50% relative humidity. After being allowed to stand, the dynamic print density is determined again in three places on the black-colored surfaces with the Gretag MacBeth type D19C NB/U densitometer. The respective mean values of the measurements before and after the treated copies had been allowed to stand were calculated, and the mean value after the copy had been allowed to stand was compared with the mean value before the copy had been allowed to stand in the form of a percentage.

In a preferred embodiment, it is possible for the heat-sensitive recording layer to contain more than one film former selected from the above list. However, besides these substances specified as color formers, the recording material of the invention can also contain one or more of the following compounds that absorb in the near infrared region:

3,6-bis(dimethylamino)fluorene-9-spiro-3'-(6'-dimethylaminophthalide), 3-diethylamino-6-dimethylaminofluorene-9-spiro-3'-(6'-dimethylaminophthalide), 3,6-bis(diethylamino)fluorene-9-spiro-3'-(6'-dimethylaminophthalide), 3-dibutylamino-6-dimethylaminofluorene-9-spiro-3'-(6'-dimethylaminophthalide), 3-dibutylamino-6-diethylaminofluorene-9-spiro-3'-(6'-dimethylaminophthalide), 3,6-bis(dimethylamino)fluorene-9-spiro-3'-(6'-diethylaminophthalide), 3-diethylamino-6-dimethylaminofluorene-9-spiro-3'-(6'-diethylaminophthalide), 3-dibutylamino-6-dimethylaminofluorene-9-spiro-3'-(6'-diethylaminophthalide), 3,6-bis-(diethylamino)fluorene-9-spiro-3'-(6'-diethylaminophthalide), 3,6-bis(dimethylamino)fluorene-9-spiro-3'-(6'-dibutylaminophthalide), 3-dibutylamino-6-diethylaminofluorene-9-spiro-3'-(6'-diethylaminophthalide), 3-diethylamino-6-dimethylaminofluorene-9-spiro-3'-(6'-dibutylaminophthalide), and 3,3-bis[2-(4-dimethylamino-phenyl)-2-(4-methoxyphenyl)ethenyl]-4,5,6,7-tetrachlorophthalide.

In numerous series of tests on which the present document is based, it was found that to realize the best results, the ratio of the two color acceptors, i.e., the ratio of N-(p-toluenesulfonyl)-N'-3-(p-toluenesulfonyloxyphenyl)urea according to formula (1) to the urea-urethane compound according to formula (2), is ideally in an especially preferred range of 5:1 to 2.5:1, based on wt. % in the heat-sensitive recording layer. To realize desired degrees of whiteness of the heat-sensitive recording layer, it is necessary to heat the urea-urethane compounds according to formula (2) to 60° C. before they are mixed with the other color acceptor and/or with other components of the heat-sensitive recording layer and to continue this heat treatment for 24 hours without interruption.

Based on the total weight of the recording layer, the two color acceptors of formula (1) and formula (2) can account for up to 35 wt. % but preferably 25-30 wt. % of the heat-sensitive recording layer. The overall effect produced by the mixture of the two color acceptors is a combination that results from the characteristics of the two individual color acceptors. While after many experiments and cross experiments, N-(p-toluenesulfonyl)-N'-3-(p-toluenesulfonyloxyphenyl)urea according to formula (1) was recognized as a color acceptor that promises a high degree of sensitivity of the heat-sensitive recording layer to the action of energy, urea-urethane compounds according to formula (2) can be described rather as color acceptors in which the print image induced by the action of energy has a high degree of stability to attempted counterfeiting and environmental effects. If both color acceptors are used in the recording layer in a mixing ratio in the range of ratios recognized by the inventors, the result is a rapidly responding heat-sensitive recording material that shows little tendency towards background graying and has a heat-induced print image that is stable with respect to environmental influences.

To increase the thermal responsiveness, the recording layer of the heat-sensitive recording material of the invention preferably also contains sensitizers with a melting point ideally of 60° C. to 180° C. and more preferably with a melting point of 80° C. to 140° C. Sensitizers of this type include, for example, benzyl-p-benzylox-benzoate, stearamide, N-methylolstearamide, p-benzylbiphenyl, 1,2-di(phenoxy)ethane, 1,2-di(m-methylphenoxy)-ethane, m-terphenyl, dibenzyloxalate, benzyl-naphthyl ether, and diphenylsulfone, where benzyl-naphthyl ether, diphenylsulfone, 1,2-di(m-methylphenoxy) ethane and 1,2-di(phenoxy)ethane are preferred Suitable binders for incorporation in the heat-sensitive recording layer are, for example, water-soluble binders, such as starch, hydroxyethylcellulose, methylcellulose, carboxymethylcellulose, gelatin, casein, polyvinyl alcohols, modified polyvinyl alcohols, sodium polyacrylates, acrylamide-acrylate copolymers, acrylamide-acrylate-methacrylate terpolymers, alkali salts of styrene-maleic anhydride copolymers, and alkali salts of ethylene-maleic anhydride copolymers, where the binders can be used alone or combined with one another. It is also possible to use water-insoluble latex binders, such as styrene-butadiene copolymers, acrylonitrile-butadiene copolymers, and methyl acrylate-butadiene copolymers, as binders for incorporation in the heat-sensitive recording layer. In accordance with the present invention, polyvinyl alcohols in combination with acrylate copolymers are especially preferred binders, which together are incorporated in the heat-sensitive recording layer in amounts of 12-21 wt. %, based on the total weight of the recording layer.

To avoid gumming at a thermal head and to avoid excessive wear of the thermal head, the coating compound for forming the heat-sensitive recording layer can also contain lubricants and parting compounds, such as metal salts of higher fatty acids, for example, zinc stearate and calcium stearate, and waxes, for example, paraffin, oxidized paraffin, polyethylene, polyethylene oxide, stearamides, and castor wax. Other components of the recording layer are, for example, pigments, preferably inorganic pigments, such as aluminum (hydr)oxide, silicic acid, and calcium carbonate. Calcium carbonate is especially preferred and is incorporated in the recording layer in a preferred amount of 10-20 wt. %, based on the total weight of the recording layer.

To guarantee good contrast between print images and blank recording layer, the recording layer preferably has a whiteness in the range of 79-85% with the use of light without a UV component and a whiteness in the range of 87-93% with the use of light with a UV component, measured according to ISO 2469/ISO 2470, but with D65 light being used at a viewing angle of 8°.

Suitable coating devices for applying the heat-sensitive recording layer include especially doctor roll coaters, doctor blade coaters, curtain coaters, or air brushes. In accordance with a preferred embodiment, an aqueous coating compound is used to form the recording layer. The coating compound is then usually dried by a method in which heat is supplied, such as by hot-air suspension driers or contact driers. A combination of the cited drying methods has also proven effective. The weight per unit area of the heat-sensitive recording layer is preferably 2-6 g/m$^2$, and especially 2.3 to 5.8 g/m$^2$.

A pigmented intermediate layer is preferably placed between the recording layer and the substrate of the heat-sensitive recording material of the invention. If, in a preferred embodiment of the invention, the intermediate layer is applied with leveling coating devices, such as roll coaters, doctor blade coaters, or doctor roll coaters, then the intermediate layer also makes a positive contribution to the leveling of the substrate surface, so that the amount of coating compound that must be applied for the heat-sensitive recording layer is reduced. The weight per unit area of the intermediate layer is preferably 5-20 g/m$^2$, and especially 7-12 g/m$^2$.

If inorganic oil-absorbing pigments are incorporated in the intermediate layer situated between the recording layer and the substrate, these pigments can absorb the wax components liquefied by the heating action of the thermal head during the formation of the print image and are thus conducive to even faster and more reliable functioning of the heat-induced recording. Therefore, an embodiment with this feature is preferred.

It is especially advantageous if the pigments of the intermediate layer have an oil absorption capacity of at least 80 cm$^3$/100 g and still better an oil absorption capacity of 100 cm$^3$/100 g, as determined by the Japanese Standard JIS K 5101. Calcined kaolin has been found to be especially effective due to the large absorption reservoir formed by its pores. However, the following inorganic pigments are also very well suited as constituents of the intermediate layer: silicon dioxide, bentonite, calcium carbonate, and aluminum oxide (especially boehmite). Mixtures of several different types of inorganic pigments are also conceivable.

Tests showed that the incorporation of organic pigments in the pigmented intermediate layer can also be very advantageous, which is due to the fact that organic pigments are especially conducive to a high heat reflection capacity of the intermediate layer. The organic, so-called hollow pigments present in an intermediate layer of a heat-sensitive recording material contain air in their interior, which constitutes a good thermal insulator. The intermediate layer, thus optimized as a heat reflection layer, increases the response characteristic of the recording layer, which significantly increases the resolution capability of the recording layer and also increases the printing speed in the thermal printer.

The quantitative ratio between organic and inorganic pigment is a compromise between the effects produced by the two types of pigment, which is resolved in an especially advantageous way if the pigment mixture contains 5-30 wt. % organic pigment, or better 8-20 wt. %, and 95-70 wt. % inorganic pigment, or better 92-80 wt. %. Pigment mixtures of different organic pigments are conceivable.

Besides the inorganic pigments and possibly organic pigments as well, the pigmented intermediate layer contains at least one binder, preferably one that is based on a synthetic polymer. Styrene-butadiene latex, for example, produces especially good results. The use of a synthetic binder that is admixed with at least one natural polymer, such as starch, which is especially preferred, is an especially suitable embodiment. According to tests with inorganic pigments, it was also determined that a binder-pigment ratio within the pigmented intermediate layer of between 3:7 and 1:9, in wt. % in each case, represents an especially suitable embodiment.

Although the substrate is not limited to paper, paper is the preferred substrate, especially a non-surface-treated coating base paper, which preferably has a weight per unit area 45-130 g/m$^2$. This type of paper is commercially successful, in part due to its environmental compatibility due to its good recyclability, and is preferred in accordance with the invention. A non-surface-treated coating base paper is understood to mean a coating base paper that has not been treated in a size press or in a coating device. In this regard, in accordance with the present invention, especially a non-surface-treated, beater sized coating base paper with an inorganic pigment, especially calcium carbonate, in the pulp is regarded as suitable. Foils, e.g., polyolefin foils, and paper coated with polyolefin can possibly be used for the invention, but an embodiment of this type does not exclude the use of other possible substrates.

The specifications with respect to weight per unit area and with respect to wt. % (percent by weight) that are given in the specification and in the claims are based on the absolutely dry weight, i.e., parts by weight absolutely dry.

EXAMPLES

The invention will now be further explained on the basis of Actual Example 2 and Comparison Examples 1 and 3.

A substrate paper with a weight per unit area of 53 g/m$^2$ is produced as the substrate on a Fourdrinier paper machine from bleached and ground deciduous and coniferous wood pulps with the addition of 0.6 wt. % (absolutely dry) resin size as beater sizing and other customary additives, based on the total solids content (absolutely dry) of the pulp supplied to the paper machine. An intermediate layer is applied on the front side with a doctor blade. The intermediate layer contains calcined kaolin as pigment, styrene-butadiene latex as binder, starch as cobinder, and other additives and has a weight per unit area of 9 g/m$^2$.

One of three different heat-sensitive recording layers, each with a weight per unit area of 5.4 g/m$^2$, is applied to this pigmented intermediate layer by a doctor roll coater. The aqueous coating compounds used for this purpose contain the following components according to the formulations reproduced in Table 1:

- color former (Fb): 3-dibutylamino-6-methyl-7-anilinofluoran,
- color acceptor (Fa) 1: N-(p-toluenesulfonyl)-N'-3-(p-toluenesulfonyloxyphenyl)urea according to formula (1),
- color acceptor (Fa) 2: urea-urethane compound according to formula (2),
- sensitizer (Sb): benzylnaphthyl ether,
- binder (Bm): polyvinyl alcohol,
- cobinder (Cb): acrylate copolymer, and
- pigment (Pm): calcium carbonate

TABLE 1

| Values in wt. % (abs. dry), based on the total weight of the heat-sensitive recording layer | Comparison Example 1 | Example 2 according to the invention | Comparison Example 3 |
|---|---|---|---|
| Fb (ODB-2) | 9 | 9 | 9 |
| Fa 1 (Pergafast ® 201, manufacturer: CIBA | 25.7 | 22.4 | 9.3 |
| Fa 2 (UU, manufacturer: Asahi) | 2.3 | 5.6 | 18.7 |
| Sb (BNE) | 20 | 20 | 20 |
| Bm (PVA) | 7 | 7 | 7 |
| Cb | 6 | 6 | 6 |
| Pm (calcium carbonate) | 15 | 15 | 15 |

Other constituents of the heat-sensitive recording layer that are not specified in the form of percentages and based on the total weight in wt. % (absolutely dry) include dispersing agents, antifoaming agents, optical brighteners, thickeners, waxes, and crosslinking agents.

In Example 2 according to the invention, the ratio, based on the wt. % (absolutely dry), of color acceptor (Fa) 1=N-(p-toluenesulfonyl)-N'-3-(p-toluenesulfonyloxyphenyl)urea according to formula (1) to color acceptor (Fa) 2=urea-urethane compound according to formula (2) is 4:1 and thus in the middle of the range that is especially preferred in accordance with the invention. In Comparison Example 1, this ratio is 11:1, which means that very little urea-urethane compound according to formula (2) is used in the heat-sensitive recording layer in relation to N-(p-toluenesulfonyl)-N'-3-(p-toluenesulfonyl-oxyphenyl)urea according to formula (1). In Comparison Example 3, the ratio is 1:2, which means that a very large amount of urea-urethane compound according to formula (2) is used in the heat-sensitive recording layer in relation to N-(p-toluenesulfonyl)-N'-3-(p-toluenesulfonyl-oxyphenyl)urea according to formula (1).

After specimens of heat-sensitive recording materials according to Comparison Examples 1 and 3 and Example 2 in accordance with the invention are produced, to determine the dynamic print densities and the percent resistance to a 25% ethanol solution, to water, and to a plasticizer—as described in detail above in the specification—black/white checkered thermal test copies are prepared with a device of the type Atlantek 400 manufactured by the company Printrex (USA), in which a thermal head with a resolution of 300 dpi and an energy per unit surface area of 9 mJ/mm$^2$ (dynamic print densities) or 16 mJ/mm$^2$ (percent resistance values) is used. The print density of the black-colored surfaces themselves is measured with a Gretag MacBeth type D19C NB/U densitometer (Gretag MacBeth, 8105 Regensdorf, Switzerland). The following measured values are obtained (Table 2):

TABLE 2

| | Comparison Example 1 | Example 2 according to the invention | Comparison Example 3 |
|---|---|---|---|
| Dynamic print density [ODU] | 1.09 | 0.97 | 0.80 |
| Percent resistance to a 25% ethanol solution [%] | 89 | 94 | 95 |
| Percent resistance to water [%] | 97 | 98 | 99 |
| Percent resistance to plasticizer [%] | 76 | 93 | 95 |
| Whiteness* [%] | 81.7 | 81.1 | 81.3 |

*measured according to ISO 2469/ISO 2470 with the use of D65 light without a UV component at a viewing angle of 8°

Extensive market analysis shows that heat-sensitive recording materials according to Comparison Example 1 are not sufficiently stable in storage inside carrying envelopes with plasticizers and are also not sufficiently resistant to ethanol, while the dynamic print density is seen as excellent. On the other hand, the dynamic print density of heat-sensitive recording materials according to Comparison Example 3 is characterized as clearly too low. Only heat-sensitive recording materials according to Example 2 in accordance with the invention are satisfactory with respect to sensitivity and resistance to environmental influences. They are also found to exhibit sufficiently great ability to be stamped and cancelled.

The above example in accordance with the invention and the two Comparison examples demonstrate that heat-sensitive recording materials of the invention can satisfactorily meet the demands placed on them.

The invention claimed is:

1. A heat-sensitive recording material with comprising a substrate and a heat-sensitive recording layer that contains one or more color formers and two color acceptors, characterized by the fact that wherein the color formers are selected from the list comprising: 3-diethylamino-6-methyl-7-anilinofluoran, 3-dibutylamino-6-methyl-7-anilinofluoran, 3-(N-methyl-N-propyl)amino-6-methyl-7-anilinofluoran, 3-(N-ethyl-N-isoamyl)amino-6-methyl-7-anilinofluoran, 3-(N-methyl-N-cyclohexyl)amino-6-methyl-7-anilinofluoran, 3-(N-ethyl-N-tolyl)amino-6-methyl-7-anilinofluoran, and 3-(N-ethyl-N-tetrahydrofuryl) amino-6-methyl-7-anilinofluoran, and the heat-sensitive recording layer contains two color acceptors, which are: N-(p-toluenesulfonyl)-N'-3-(p-toluenesulfonyloxyphenyl)urea with having the following formula (1):

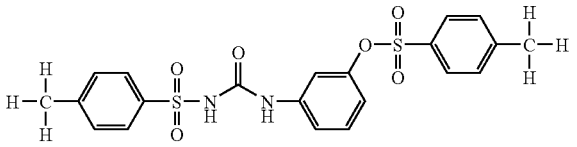

and a urea-urethane compound with having the following formula (2):

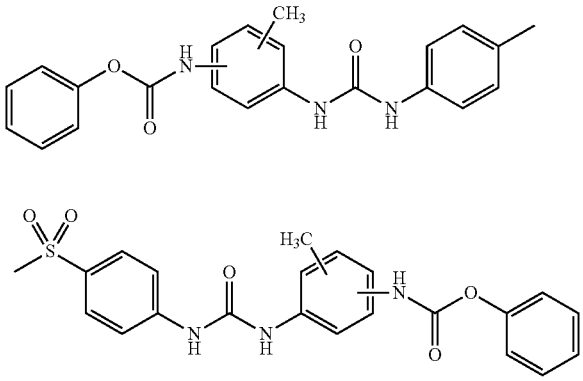

wherein the ratio of the two color acceptors, i.e., the ratio of N-(p-toluenesulfonyl)-N'-3-(p-toluenesulfonyloxyphenyl)urea according to formula (1) to the urea-urethane compound according to formula (2), is in the range of 10:1 to 1:1, based on wt. % in the heat-sensitive recording layer.

2. A heat-sensitive recording material in accordance with claim 1, characterized by the fact that wherein the dynamic print density of a thermal test copy produced with a thermal printing head at a resolution of 300 dpi and an energy per unit surface area of 9 mJ/mm$^2$ is in the range of 0.91 to 1.03 ODU.

3. A heat-sensitive recording material in accordance with either of claim 1 and claim 2, characterized by the fact that wherein the percent resistance of a thermal test copy produced with a thermal printing head at a resolution of 300 dpi is in the range of 91.5% to 96.5% with respect to a 25% ethanol solution, in the range of 95.5% to 99.5% with respect to water, and in the range of 90.5% to 95.5% with respect to plasticizers (TESA®-Grafik-Film 57331).

4. A heat-sensitive recording material in accordance with any of claims 1 to 3, characterized by the fact that wherein the recording layer has a whiteness in the range of 79-85% with the use of light without a UV component, measured according to ISO 2469/ISO 2470 with the use of D65 light at a viewing angle of 8°.

5. A heat-sensitive recording material in accordance with claim 1, characterized by the fact that wherein the recording layer has a whiteness in the range of 87-93% with the use of light with a UV component, measured according to ISO 2469/ISO 2470 with the use of D65 light at a viewing angle of 8°.

6. A heat-sensitive recording material in accordance with any of claims 1 to 5, characterized by the fact that wherein a pigmented intermediate layer is formed between the substrate and the heat-sensitive recording layer.

7. The heat-sensitive recording material of claim 1, wherein the ratio of urea compound according to formula (1) to the urea-urethane compound according to formula (2) is in the range of from 5:1 to 2.5:1.

8. A ticket comprising a substrate and a heat-sensitive recording layer that contains one or more color formers and two color acceptors as a ticket or passenger ticket, wherein, the color formers are selected from the list comprising: 3-diethylamino-6-methyl-7-anilinofluoran, 3-dibutylamino-6-methyl-7-anilinofluoran, 3-(N-methyl-N-propyl)amino-6-methyl-7-anilinofluoran, 3-(N-ethyl-N-isoamyl)amino-6-methyl-7-anilinofluoran, 3-(N-methyl-N-cyclohexyl)amino-6-methyl-7-anilinofluoran, 3-(N-ethyl-N-tolyl)amino-6-methyl-7-anilinofluoran, and 3-(N-ethyl-N-tetrahydrofuryl) amino-6-methyl-7-anilinofluoran, and the heat-sensitive recording layer contains two color acceptors, which are: N-(p-toluenesulfonyl)-N'-3-(p-toluenesulfonyloxyphenyl)urea with having the following formula (1):

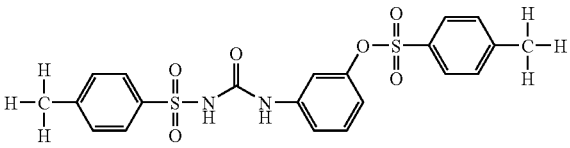

and a urea-urethane compound with having the following formula (2):

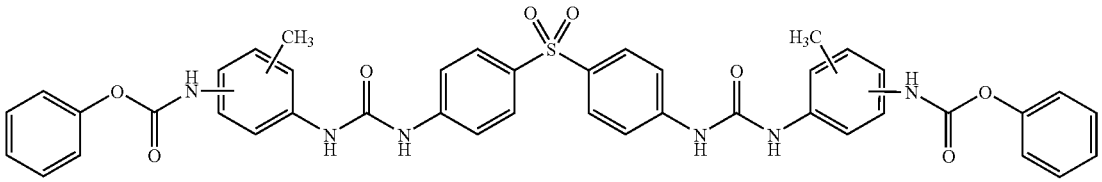

wherein the ratio of the two color acceptors, i.e., the ratio of N-(p-toluenesulfonyl)-N'-3-(p-toluenesulfonyloxyphenyl)urea according to formula (1) to the urea-urethane compound according to formula (2), is in the range of 10:1 to 1:1, based on wt. % in the heat-sensitive recording layer.

9. The ticket of claim 8, wherein the ratio of urea compound according to formula (1) to the urea-urethane compound according to formula (2) is in the range of from 5:1 to 2.5:1.

* * * * *